United States Patent [19]

Bross

[11] 4,241,293

[45] Dec. 23, 1980

[54] SCANNER FOR DETECTING AND INDICATING MISSING AND WEDGED ARTICLES IN SLAT-TYPE COUNTING MACHINE

[75] Inventor: Charles F. Bross, Chicago, Ill.

[73] Assignee: Pennwalt Corporation, Philadelphia, Pa.

[21] Appl. No.: 66,604

[22] Filed: Aug. 15, 1979

[51] Int. Cl.[3] ..... G06M 7/00

[52] U.S. Cl. ..... 235/92 PK; 198/503; 235/92 V; 250/223 R

[58] Field of Search ..... 235/92 PK, 92 V, 98 C; 250/222 PC, 223 R; 198/503

[56] References Cited

U.S. PATENT DOCUMENTS

| | | | |
|---|---|---|---|
| 3,678,254 | 7/1972 | Graff | 235/92 PK |
| 3,717,751 | 2/1973 | Fluck | 235/92 PK |
| 3,928,753 | 12/1975 | Kivett et al. | 235/92 PK |
| 3,980,180 | 9/1976 | Jamieson | 250/223 R |

*Primary Examiner*—Joseph M. Thesz

[57] ABSTRACT

A slat-type article counting machine includes slats provided with cavities which carry the articles, an exact count of which are designed to be discharged into bottles or containers. Each cavity defines a hole which penetrates the entire slat depth. Two pairs of scanners are mounted to the machine, one for detecting missing articles from cavities and the other for detecting articles wedged or blocked therein. A pair of scanners comprises sensors which include an array board having multiple light-emitting diodes which project light beams through the holes provided in the cavities to thereby strike photoelectric cells mounted to another array board, which photoelectric cells generate signals which cooperate with sensing and logic circuits for effecting visual and audible means for indicating miscounts due to empty or blocked cavities. A wide range of auxiliary operations and functions may additionally be initiated by the signals.

8 Claims, 7 Drawing Figures

SCANNER FOR DETECTING AND INDICATING MISSING AND WEDGED ARTICLES IN SLAT-TYPE COUNTING MACHINE

CROSS-REFERENCE TO OTHER RELATED PATENT APPLICATIONS

Reference is made to copending patent application of Charles F. Bross for "Article Counting Machine," Ser. No. 897,234, filed Apr. 17, 1978, assigned to the assignee hereof, now U.S. Pat. No. 4,185,734.

STATEMENT OF THE INVENTION

This invention relates to slat-type counting machines particularly adapted for small discrete articles and provides improved scanning means for detecting and indicating missing or wedged articles in slat cavities to insure proper counting of the articles.

BACKGROUND AND SUMMARY OF THE INVENTION

In counting machines of the type contemplated by the present invention and described in the cross-referenced patent application, a conveyor carries a plurality of elongated slat members having uniformly spaced cavities provided therein, each of which is caused to contain a tablet, capsule, or the like, to be counted. The slats are carried in a closed loop path in a direction transverse to the direction of slat elongation are are gradually inverted in order to discharge their contents into chutes or containers for counting. Because of present day multi-shaped capsules and tablets, many uncoated, it is not an infrequent occurrence for a cavity to fail to discharge its capsule due to an absence of one in that cavity, or a wedging of one therein, either of which fault may produce a miscount, and, if not corrected, may provide continuous miscounts. With more stringent controls being emphasized by federal drug agencies as well as more accurate counts by corporate quality control departments, it becomes increasingly important to detect any missing articles, or wedged articles which suitable ejector means has failed to unwedge, and to indicate such fault or condition to the operator for corrective action.

The present invention satisfies the abovementioned requirements. Briefly, the invention provides a light source beneath each slat cavity of a single row, and photoelectric detecting means in opposing receiving relationship to the light sources for sensing an empty cavity, or a wedged article or product in a cavity. Visible lamp means will indicate a fault, i.e., an empty or wedged cavity and the particular bottle associated therewith which has, or will receive the miscount. The visible means may be accompanied by an audible alarm signal. The operator, in response to such fault indication, can usually correct the fault by performing a simple corrective manual operation, or automatic functions may be triggered into action by means of output signals generated by the photodetecting means, such, for example, as shunting an appropriate bottle off the conveyor line.

DETAILED DESCRIPTION OF THE INVENTION

Figure 1:
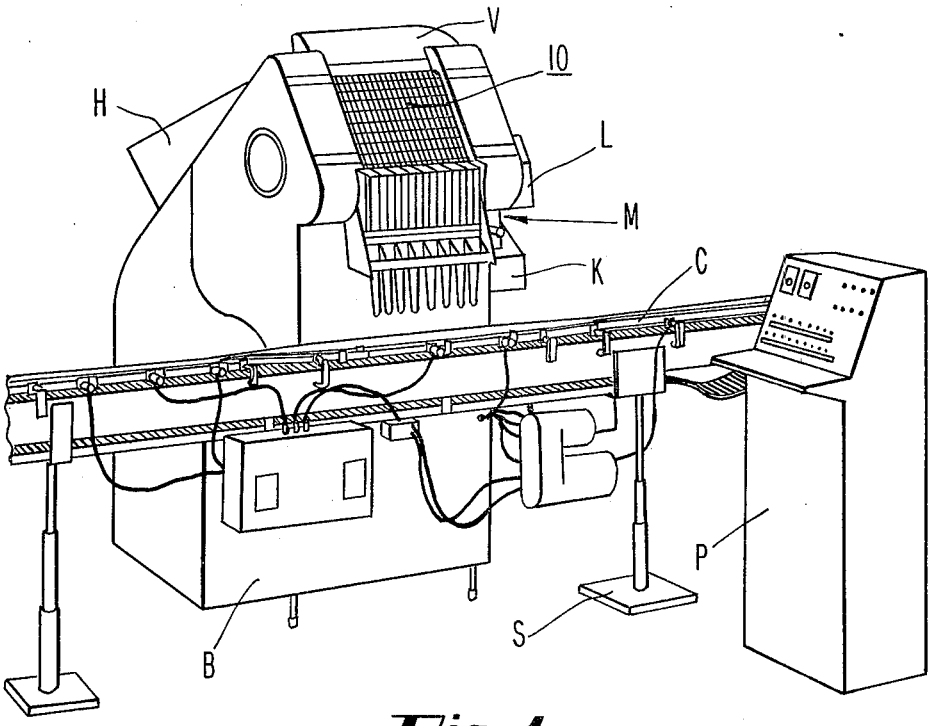
FIG. 1 is a perspective view of a slat-type counting machine with which the present scanner may be employed.

Referring now to the drawings, and more particularly to FIGS. 1, 2, 3 and 4 thereof, elongated slats 10, having a multiplicity of cavities 12 spaced therein, are caused to travel below feed hooper H to receive the articles to be counted, such as capsules, tablets, pills, bolus, and the like. Each tablet or capsule, for example, finds an empty cavity, and is then transported upwardly at a moderately inclined angle before proceeding downwardly through an inspection area, which area coincides generally with the area represented by slats 10 in FIG. 1. The articles are then discharged into a manifold system M before dropping, by force of gravity, into bottles or containers transported by a conveyor system C, preferably in a continuous-fill-operation during which operation the bottles or containers receive the counted tablets.

Base cabinet B, support members S, console control panel P, and other components associated with the machine are illustrated to place them in perspective and to facilitate a clearer understanding of the present invention.

Microprocessor logic circuitry L and related components K associated with the present scanners are secured to a side of the machine.

Figure 2:
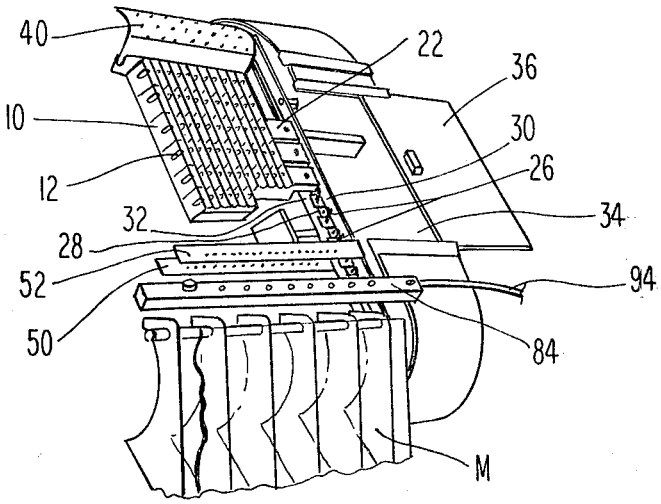
FIG. 2 is a fragmentary perspective view of slat-conveying mechanism of FIG. 1 showing one of the scanners in an operable position.
Figure 3:
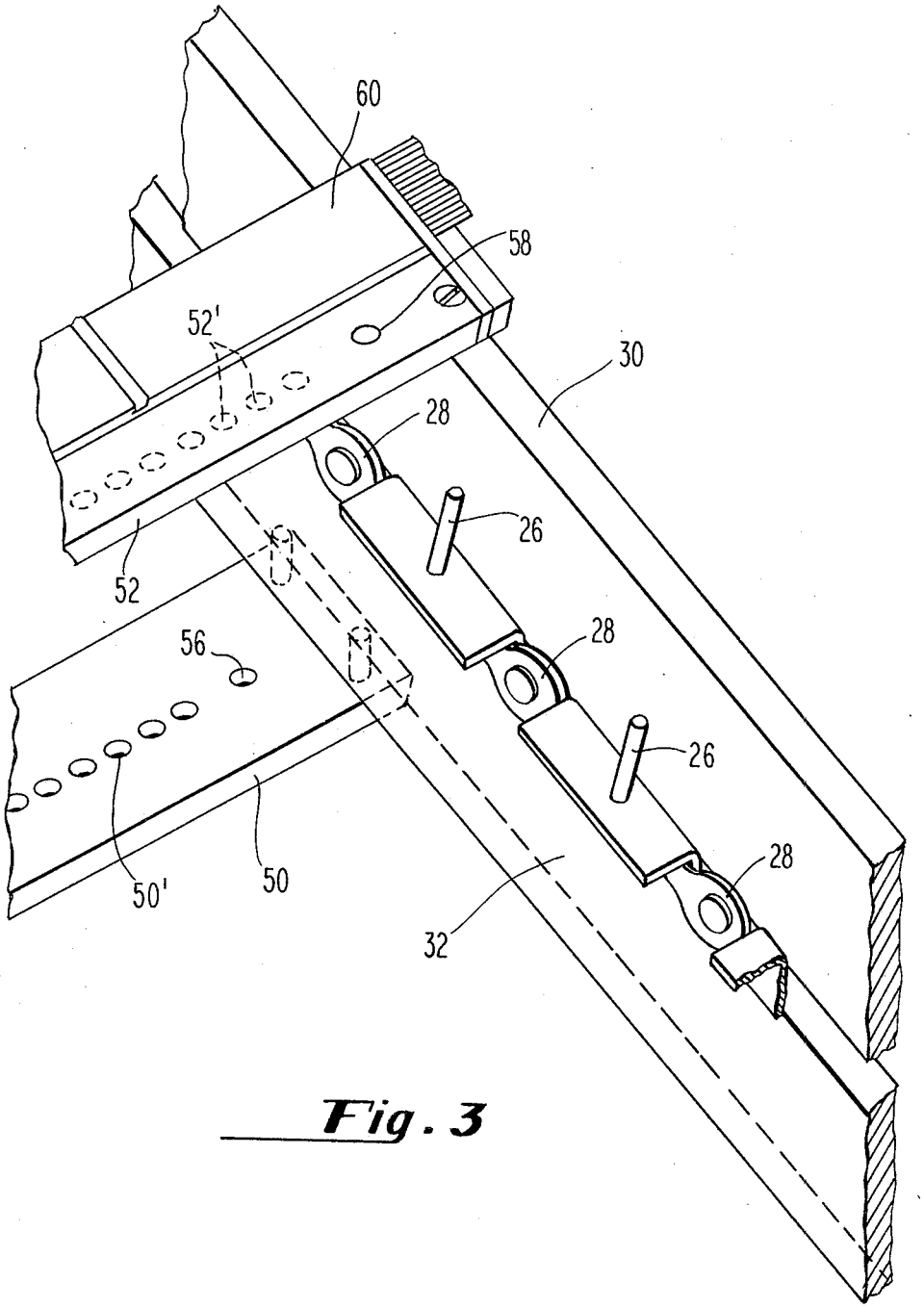
FIG. 3 is an enlarged perspective view of the scanner illustrated in FIG. 2.

Cavities 12 may be precision-milled within slats 10 in order to accommodate specific sizes and shapes of any article to be counted. The slat shown in FIG. 4 comprises two rows of cavities. Each slat 10 is provided with partitions 16 for transversely separating the cavities. Each fifth partition 18 is slightly wider than the preceding four. Thus, 10 capsules, or multiples thereof, from each like slat, will be discharged into a preselected chute or manifold. The slats may be provided with a single row of cavities, as illustrated in FIG. 2, or with any convenient number, and may, or may not require the presence of wider partitions 18.

A cradle 20, of steel, for example, embraces the lower portion or base 21 of each slat 10 and provides rigidity thereto. Slats 10 have end portions 22, each having an aperture 24 therethrough for receiving a lug pin 26 (FIG. 3) of endless conveyor chains 28 supported on identical left and right chain guides, each comprising an outer guide 30 and inner guide 32 rigidly attached to side plates 34 (FIG. 2) of the counting machine.

A sliding panel 36 permits easy access within the counting machine. Brush 40, downstream from hopper H, rotates in a direction opposing the general direction of travel of the slats. Brush 40 urges the tablets or capsules which have not found a cavity 12 back towards the fill area for deposition into an oncoming empty cavity.

Brush 40 also assists in the removal of dust particles, and the like, into a suitable suction device V.

Figure 4:
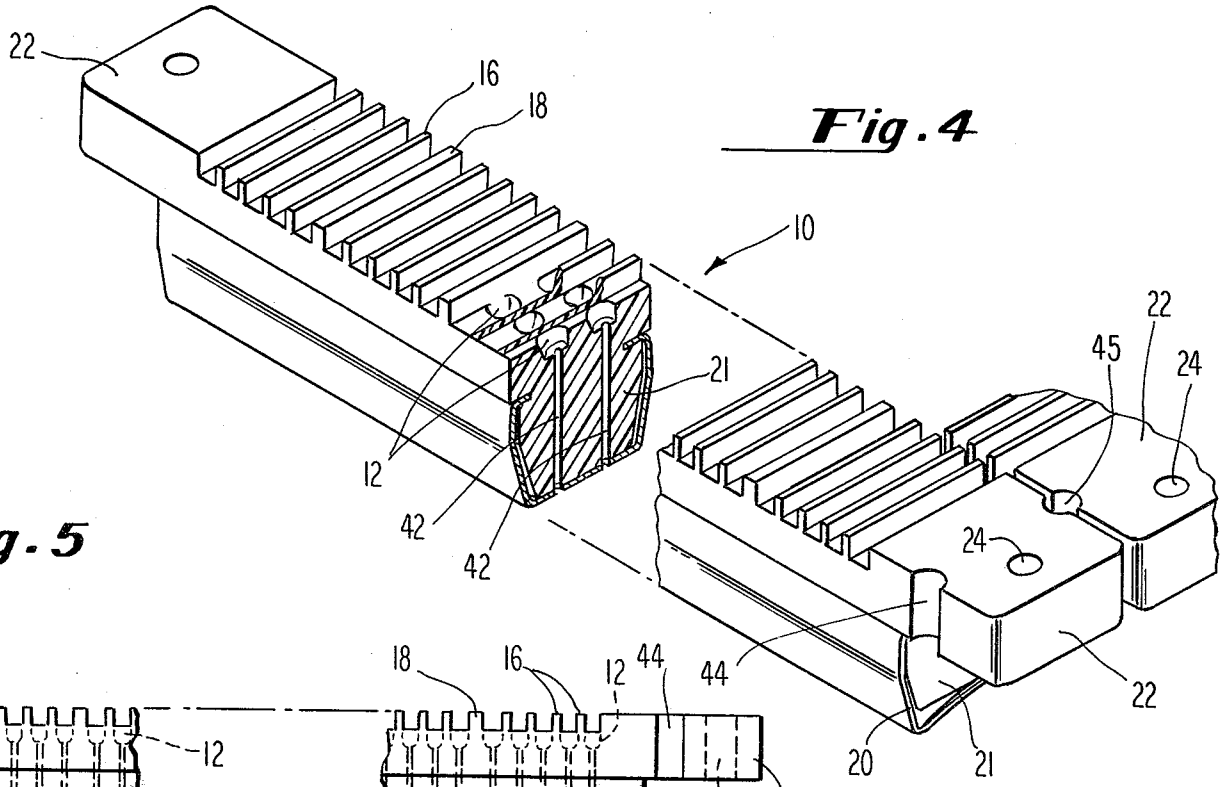
FIG 4 is a perspective view of a slat member usable in the machine of FIG. 1, modified in accordance with one aspect of the present invention.
Figure 5:
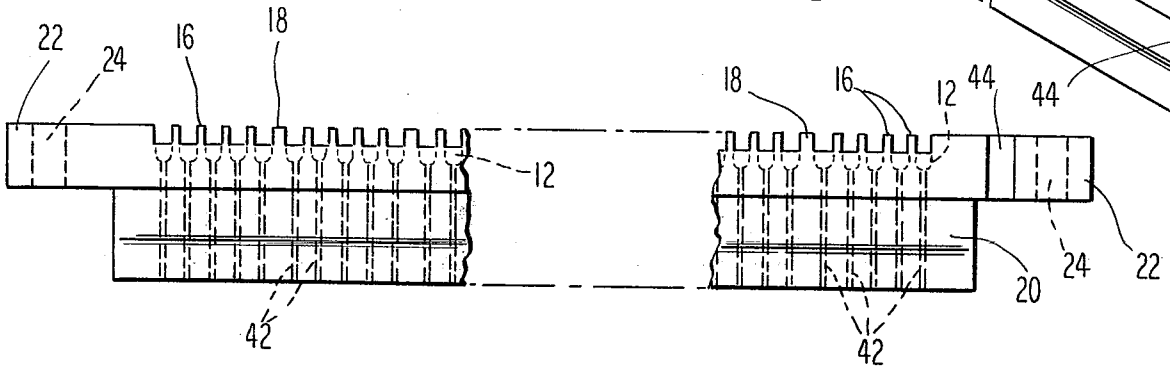
FIG. 5 is a side view of the slat member of FIG. 4.

In accordance with an essential feature of the invention, slats 10 are modified as shown in FIGS. 4 and 5. Each cavity 12 is provided with a hole 42 axially therethrough which penetrates the entire slat including base 21 as well as cradle 20, and a semi-circular triggering hole 44 provided on each opposing side face of end portion 22 on the right hand side only of each slat 10. Purpose of holes 42 and 44 are later described.

Figure 6:
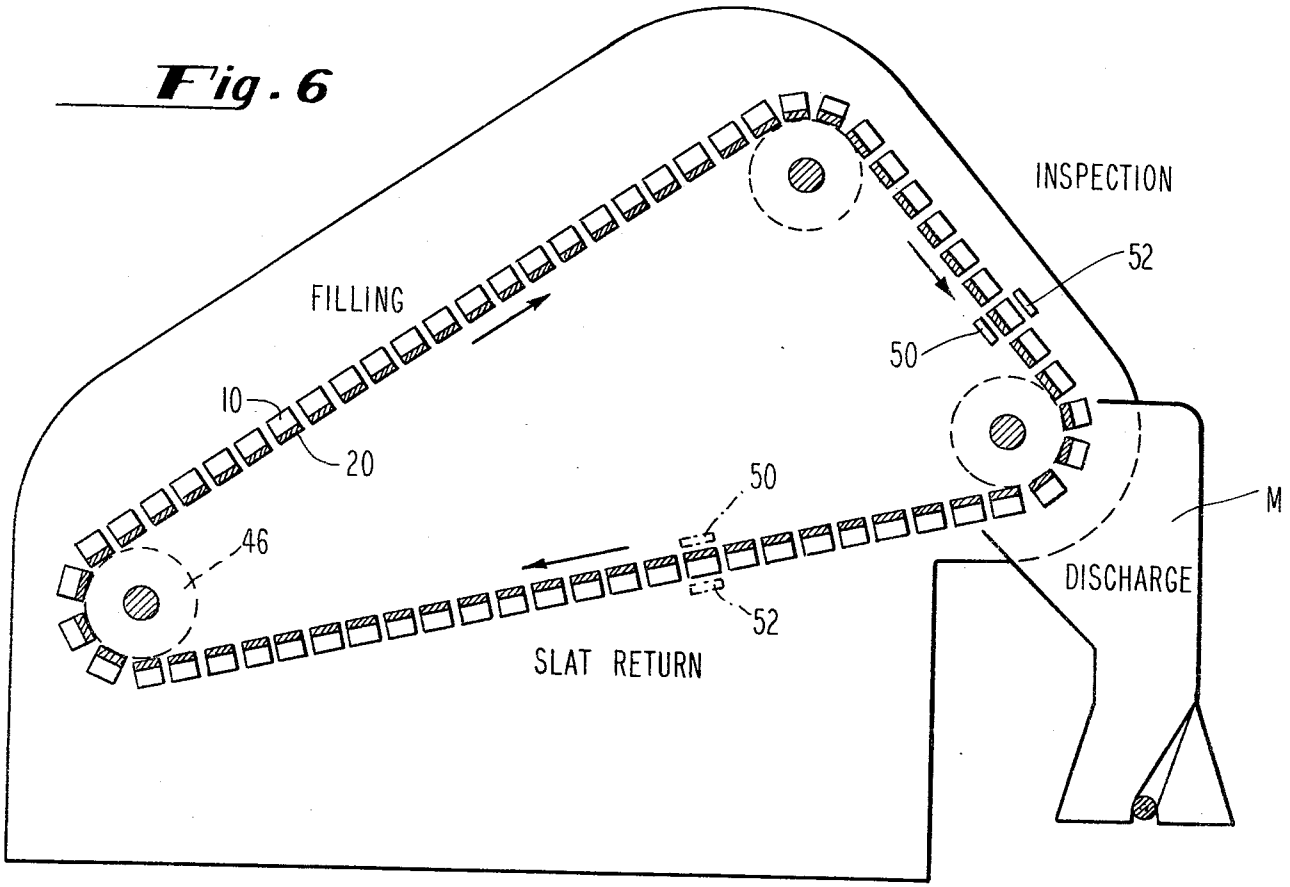
FIG. 6 is a diagrammatic illustration of a typical path of travel of the slat members, and locations of the two scanners of the present invention.
Figure 7:
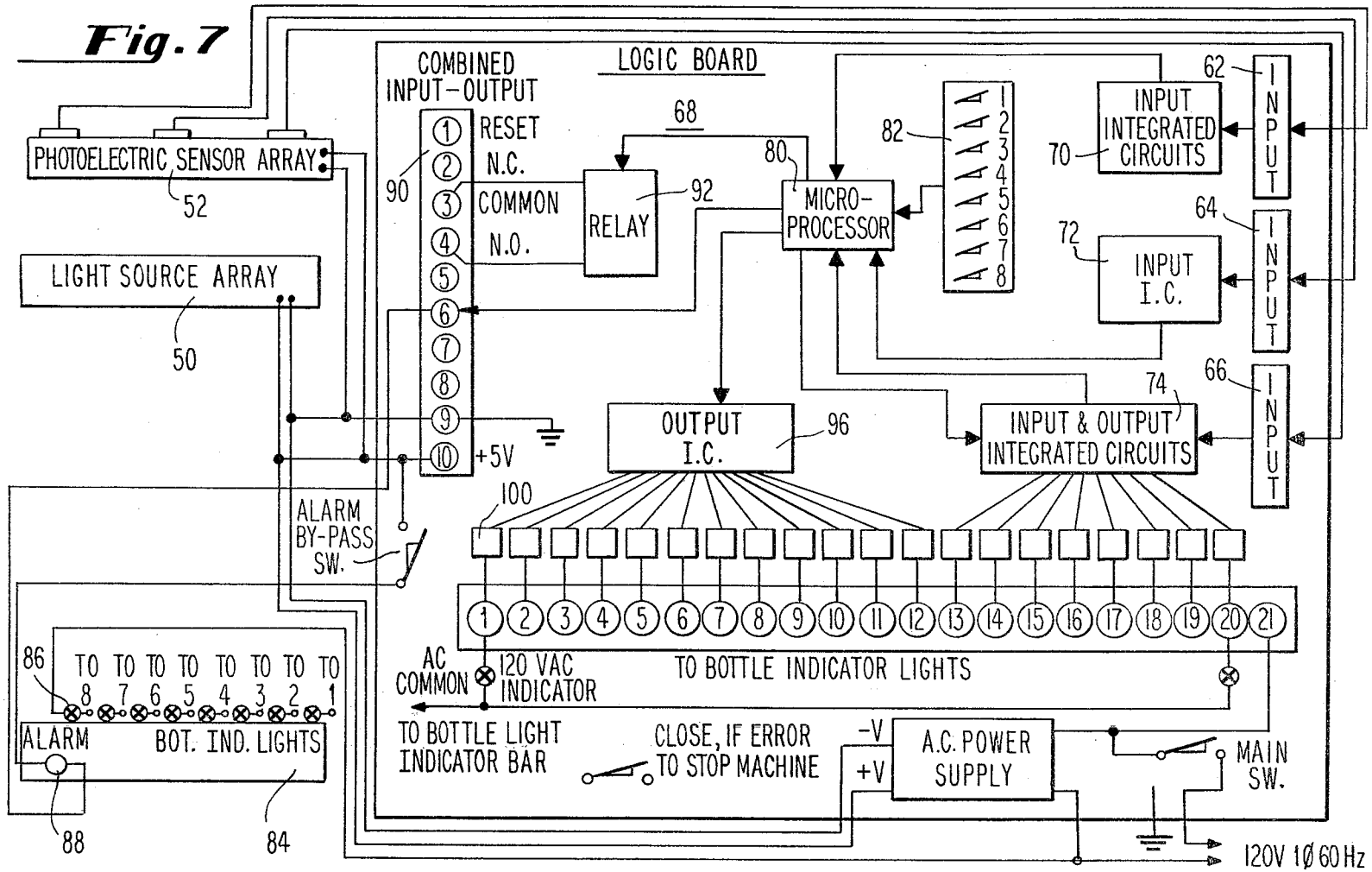
FIG. 7 is a schematic representation of the sensing, logic, and associated components of the scanners of the present invention.

The article filling station area, inspection area, discharge station area, and slat return area, are designated in FIG. 6. Slats 10 move in a generally clockwise direction in a closed loop path by means of chains 28 abovementioned which are driven by sprockets 46, controlled by a suitable motor (not shown).

A scanner of the present invention includes sensors comprising a slim plastic case containing an array 50 of multiple light sources (FIG. 3), typically light emitting diodes 50'; and another plastic case containing an array 52 of multiple photodetecting means, suitably photoelectric cells 52', each array or array board being threadedly mounted to both the right and lift chain guides. Array board 50 is mounted to an underside of inner chain guide 32 and array board 52 is mounted to an upper edge of outer chain guide 30, shown clearly in FIG. 3. In practice, approximately 3 inches will separate the array boards. Each array board will contain an identical number of light emitting diodes 50' and photoelectric cells 52', which number equals the number of cavities in a single row of a cavity-carrying slat used in the system. The array boards are carefully fabricated in order to precisely match the tablet array of the slats. Changing the tablet array pattern requires a change of array boards 50 and 52 which conforms with that pattern.

It should be borne in mind that the present invention contemplates the sensors aforedescribed not only at the front or inspection station for the sensing of missing products or tablets prior to their discharge, but another set of similar sensors disposed similarly to the inner and outer chain guides at the slat return station for sensing blocked or wedged tablets. In the main, the invention will be described with reference to the front scanner, it being understood that the sensing of wedged products is at least of equal importance.

Referring now to the front sensing means, it is apparent that a cavity containing a tablet, for example, will interrupt the light beam emanating from its respective LED 50' thus providing no visible or audible outputs through sensing and logic means, later described. Conversely, an empty cavity permits the light beam from its respective LED 50' to strike a photoelectric cell 52' for generating appropriate singles to alert the operator to correct the fault, or, if desired, to automatically shift an appropriate bottle off the conveyor line.

Each slat 10 is provided with semi-circular passageways 44 as abovementioned. Thus, adjacent passageways 44 of successive slats will form a circular opening 45 therebetween through which a light beam from another LED 56 mounted to array board 50 will pass to strike a trigger cell 58 mounted to the underside of photoelectric cell array board 52. Openings 45 are aligned with LED 56 and trigger cell 58. Trigger cell 58 prevents false alarms caused by light beams generated by any of LEDs 50' striking any of the photoelectric cells 52' of array board 52 when the beams are passing through the space formed between slat interfaces while successive slats are being transported in their closed loop path. When a light beam from LED 56 strikes trigger cell 58 through an opening 45, sensing circuits associated with the photodetecting means are instantly deactivated and are automatically reactivated prior to passage of cavity holes 42 between light emitting diodes 50' and photoelectric cells 52'. This cycle of circuit deactivation and reactivation is continuously repeated each time an opening 45 aligns itself between LED 56 and trigger cell 58.

In order to insure the proper timing and duration of the deactivation period, opening 45 will have a diameter of about ¼ inch. The space between moving slat interfaces is nominally 0.015 to 0.020 inches.

In further clarification of the invention, assume slats 10 are provided with a double row of cavities 12, each row containing 40 cavities; and 8 bottles are to be each filled with a specified number of tablets. Thus, array boards 50 and 52 will each contain 40 light emitting diodes 50' and photoelectric cells 52' respectively. The photoelectric cell array may conveniently comprise three modules of 16, 16 and 8 cells. Leading from the photoelectric cells will be a 40-wire flat cable strip 60 (FIG. 3) which wires are fed into inputs 62, 64 and 66 on logic board 68, the last-mentioned input connected to the 8 cell module. Since the output signals from photoelectric cells 52' are weak, integrated circuits (not shown) will be disposed adjacent thereto within the plastic casing of array board 52 to turn on transistor circuits to thus yield reliable and greater output voltages. Similarly, each photoelectric cell 52' is associated with an indicating light (not shown) on array board 52 which lights are visible on the front scanner for localizing the fault in the associated circuits. It is herein indicated that indicator lights will not be readily visible however in the photoelectric sensor located at the slat return area. The lights are present however to assist in localizing the "wedged" fault and are visible upon opening a cover plate.

Voltages from inputs 62 and 64 are fed into input integrated circuits 70 and 72 respectively. Voltages from input 66 are fed into input-output integrated circuit 74, i.e., it receives 8 input voltages and feeds a similar number of output voltages to triacs and terminals, later described.

All voltages or signals from the IC inputs are fed into microprocessor 80. An 8-switch DIP switch 82 whose input is a control signal such as a ground signal or voltage, programs microprocessor 80. Microprocessor 80 may contain approximately 1500 circuits and is inserted into a computer terminal which programs memories in the microprocessor to perform desired functions in a conventional manner.

Switch No. 1 of DIP switch 82 provides a timed or locked output; switches 2 through 7 control the number of bottles to be filled, i.e., 20, 10, 8, 5, 4 or 2 respectively while switch 8 is carried as a spare. Thus, switch 7 will be used in the programming of microprocessor 80 when filling 2 large drums, for example, with a large count of specified products. If 4 drums or containers are to be similarly filled, switch 6 would be depressed.

An alarm and bottle light indicator bar 84 is mounted to the counting machine below photoelectric cell array board 52 (FIG. 2) and is provided with lamps 86 equal in number to the number of bottles being filled. Mounted to bar 84 is an audible alarm 88 which is actuated simultaneously with the lighting of any of the lamps 86. It is understood, of course, that a second row of lamps on indicator bar 84 will indicate the bottle or container with the "wedged" product short count.

Alarm 88 is connected between terminals 6 and 10 of combined input-output terminal board 90; and output relay 92, connected between terminals 3 and 4 thereof may be used to stop machine operation, if and when desired. Appropriate output signals may similarly be fed to console control panel P for halting operation of the machine. Power input to terminal board 90 is across terminals 9 and 10 thereof.

Bottle indicator light bar 84 is connected to logic board 68 by means of cable 94. Bar 84 is exchanged for another whenever a different number of bottles is to be filled.

The logic circuit includes an output IC 96 which feeds terminals 1–12 of terminal board 98. Bottle indicator lights on bar 84 are connected respectively to terminals 1 through 8 on terminal board 98. Terminal board 98 has a 20 bottle capacity. Terminals 13–20 are fed by input-output IC 74. If 20 bottles, for example, are to be filled simultaneously instead of 8, bar 84 will include 20 lamps 86, and all available terminals on terminal board 98 will be used. Triacs 100 are interposed between input-output IC 74 and the terminals to turn on A.C. signals when pulsed by appropriate D.C. signals.

The sensors mounted at the slat return station, i.e., light source array board and photoelectric cell array board, will be connected to a logic board similar to board 68, both using common power supplies. Bar 84 may indicate both empty cavity faults and wedged cavity faults, or, if desired, a separate set of lamps may be used.

If it is desired to have the 40 indicator lights on the photoelectric cell array board mounted at the "wedged" cavity area readily visible, the photoelectric cells may be wired to a separate bank of indicator lights disposed in array board 52.

The present machine may include slats having no cavities therein, or blank slats, to be transported in a closed path along with the tablet-containing slats. Such a blank slat is provided with holes identical in size and spacing as cavity holes 42, and is hereafter referred to as a verification slat, whose purpose is to verify that the logic and sensing circuits are operational. Thus, if the total number of slats being transported is 72, for example, mircoprocessor 80 is programmed to receive appropriate gating signals as each slat in the system passes a predetermined point such that the 72nd, or verification slat, will be sensed when passing between array boards 50 and 52 for verification of the sensing and logic circuits. If operational, a suitably disposed green lamp, conveniently on output bar 84, will remain lit for a specified period of time. If not operational, the operator will be alerted to a fault. The verification slat is interrogated each time it passes between the sensors and normal circuits associated with that scanner are disabled at that time. Circuits are operational when the verification slat indicates 40 open holes.

The same verification slat may be employed in verifying the circuits associated with the scanner mounted at the slat return station. The microprocessor associated with this scanner will be programmed in the same mode, i.e., to verify 40 open holes.

Suitable ejector mechanism mounted before the slat return scanner is expected to dislodge most wedged tablets into the manifolds M.

Upon machine start-up many cavities will not be carrying a product. Microprocessor 80 can readily be programmed to ignore voids in over 50%, for example, of the cavities.

The sensors mounted at the slat return station will be provided with a trigger cell and LED identical with trigger cell 58 and LED 56. Here, however, the microprocessor will be programmed to detect blocked or wedged cavities when a light beam fails to pass through cavity holes 42. Circuits associated with this scanner will be deactivated upon triggering of the trigger cell, and will automatically be reactivated before passage of holes 42 between the sensors.

The D.C. power supply is well filtered and regulated. The logic packages are mounted to the side of the machine with conventional vibration isolators. The microprocessor is provided with surplus capacity, i.e., if it is desired to shunt an underfilled bottle off conveyor line C by means of a shift register; or to pulse an adder cartridge to complete a bottle fill, and the like. In the event a shift register or similar device is employed to remove a bottle from the conveyor system C, the present invention contemplates lighted push buttons on indicator bar 84 which would indicate which bottle has a short count due to an empty cavity, and would also permit an operator to input the logic counter in case of a malformed product or any other conceivable problem.

Other advantages to be derived through the practice of the present invention resides in the ease of utilizing appropriate output signals to stop the machine in a position where the operator can pulse a single line ejector; or where ejection can be readily accomplished manually. Still further, another appropriate output signal may be used to track down an underfilled container and eject it from the line.

The present invention employs indicator lights, output sensors and integrated circuits which may comprise several modules, all contained within a single slim array board to thus obviate the need for cables and banks of amplifiers normally associated therewith. The present scanner thus effects significant cost reductions and renders it more affordable by customers.

An important feature and advantage of the instant scanning mechanism resides in structure which permits banks of cavities to be simultaneously scanned and wherein the scanned products to be counted are stationary with respect to slats which carry them. Thus, it is not necessary for the product itself which is to be counted to slide along or fall through a tunnel or channel to interrupt a beam where, unlike many prior mechanisms, two such products could simultaneously trigger but a single signal. With current machines capable of releasing products at a very high rate, the chances of such errors by prior art mechanism are further increased.

I claim:

1. In an article counting machine having a series of elongated slats, means supporting said slats for movement in a closed path in a direction transverse to direction of slat elongation, each of said slats having a depth and an outer surface, said outer surface including at least a row of spaced aligned cavities along its length, said path including cavity charging and article discharging stations and a slat return station after said discharging station, means at said charging station for depositing an article in each of said cavities, means to gradually invert the slats for discharging said deposited articles for counting at said discharging station, the improvement to said machine and to a scanner in combination therewith for sensing, detecting and indicating (a) empty cavities prior to discharging of said deposited articles and (b) wedged articles in said cavities subsequent to discharging of said deposited articles and prior to said charging station, said improvement comprising a hole provided through each of said cavities penetrating said slat depth, said holes being aligned with direction of travel of said slat movement, an array board of light sources mounted to said machine, each of said light sources so positioned to project a beam of light simultaneously through a respective hole provided in said cavities comprising one of said rows, an array board of photoelectric detectors mounted to said machine, each of said detectors so positioned to be in receiving relationship for each of said beams of projected light, said deposited articles being stationary with respect to said slats in which said deposited articles are carried and transported whereby said slats containing said empty cavities passing between said array boards of light sources and photoelectric detectors fail to interrupt said projected beams and said cavities of said slats with wedged articles therein interrupt said projected beams for generation of appropriate output signals.

2. The machine of claim 1 wherein number of said light sources and photoelectric detectors are each equal in number to the number of slat-cavities provided in a single row thereof.

3. The machine of claim 2 wherein each of said light sources is a light emitting diode and each of said photoelectric detectors is a photoelectric cell.

4. The machine of claim 3 wherein said array boards of light emitting diodes and photoelectric cells are slim plastic enclosures, said enclosure containing said photoelectric cells containing, in addition, an indicator light for each photoelectric cell, and integrated circuit means mounted adjacent said photoelectric cells for increasing strength of signals generated by said photoelectric cells when struck by light beams from said light emitting diodes through said cavity holes.

5. The machine of claim 4 wherein a trigger cell and an associated light emitting diode are respectively mounted to said photoelectric cell and light emitting diode array boards at one end thereof, a semi-circular passageway disposed in each side face of an end portion of each of said slats such that adjacent slats form a circular opening therethrough at successive slat interfaces, said opening being aligned with said trigger cells and said associated light emitting diodes, said openings being of sufficient diameter to pass a light beam from said light emitting diodes associated with said trigger cells to deactivate circuits associated with said scanners to thus prevent false alarms caused by light beams emanating from said array board light emitting diodes striking said array board photoelectric cells through slat interfaces.

6. The machine of claim 5 further characterized by addition thereof of a slat without cavities supported for movement in said closed path, said slat without cavities having a multiplicity of holes therethrough, said holes being equal in number to the number of said cavities in a cavity-containing slat and aligned with each of said holes in said cavities, said holes in said slat without cavities passing light beams from said array board light emitting diodes for striking said array board photoelectric cells to thereby generate signals for verifying integrity of circuits associated with said scanners.

7. The machine of claim 6 wherein said discharged articles are deposited in containers, a container indicating bar mounted to said machine, said container indicating bar including lamps equal in number to number of containers being filled, and means for activating a lamp on said bar corresponding to a container being filled for indicating a fault in count of said container.

8. The machine of claim 7 wherein said container indicating bar includes an audible alarm activated simultaneously with activation of said lamp.

* * * * *